United States Patent [19]

Gakhar

[11] 3,990,272

[45] Nov. 9, 1976

[54] WASHING MACHINE WITH IMPROVED ADDITIVE DISPENSING MEANS

[75] Inventor: Ved P. Gakhar, Louisville, Ky.

[73] Assignee: General Electric Company, Louisville, Ky.

[22] Filed: June 23, 1975

[21] Appl. No.: 589,718

[52] U.S. Cl. ..... 68/17 R; 68/207

[51] Int. Cl.[2] ..... D06F 39/02

[58] Field of Search ..... 68/17 R, 207

[56] References Cited

UNITED STATES PATENTS

| | | | |
|---|---|---|---|
| 2,899,814 | 8/1959 | Buechler | 68/17 R X |
| 3,019,629 | 2/1962 | Ross | 68/17 R |
| 3,118,297 | 1/1964 | Olding | 68/17 R X |
| 3,320,777 | 5/1967 | Morey | 68/17 R X |
| 3,513,866 | 5/1970 | Boothe et al. | 68/17 R X |
| 3,727,434 | 4/1973 | Bochan | 68/17 R |

*Primary Examiner*—Philip R. Coe
*Attorney, Agent, or Firm*—Frederick P. Weidner; Francis H. Boos

[57] ABSTRACT

A treating agent dispenser system for an automatic washing machine of the top loading type having an outer tub and a basket spaced inwardly therefrom. There is a dispenser adapted to be mounted above the machine's wash tub and having a plurality of compartments for receiving treating agents to be dispensed into the wash tub at predetermined times in a cycle of the washing machine by liquid being introduced into the machine. One of the compartments has a channel with a drain opening in liquid flow communication with a stationary holding tank. The holding tank has means for evacuating the dilute agent mixture after liquid flow into the tank is terminated. Liquid flowing from the holding tank is directed to the space between the tub and basket. The treating agent dispenser system provides for diluting the treating agent and flushing it from its compartment with fresh incoming liquid and dispenses it into the wash water and not onto the fabrics to be washed.

5 Claims, 5 Drawing Figures

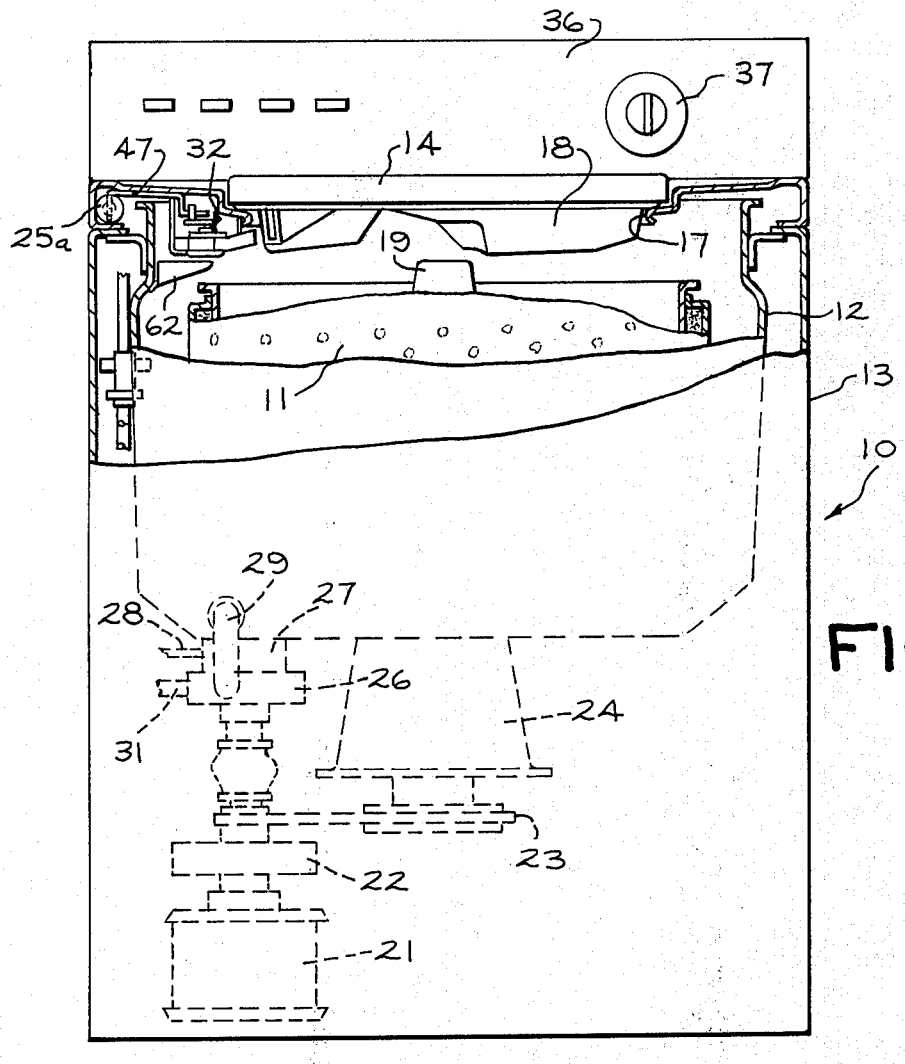
FIG. 1
FIG. 3
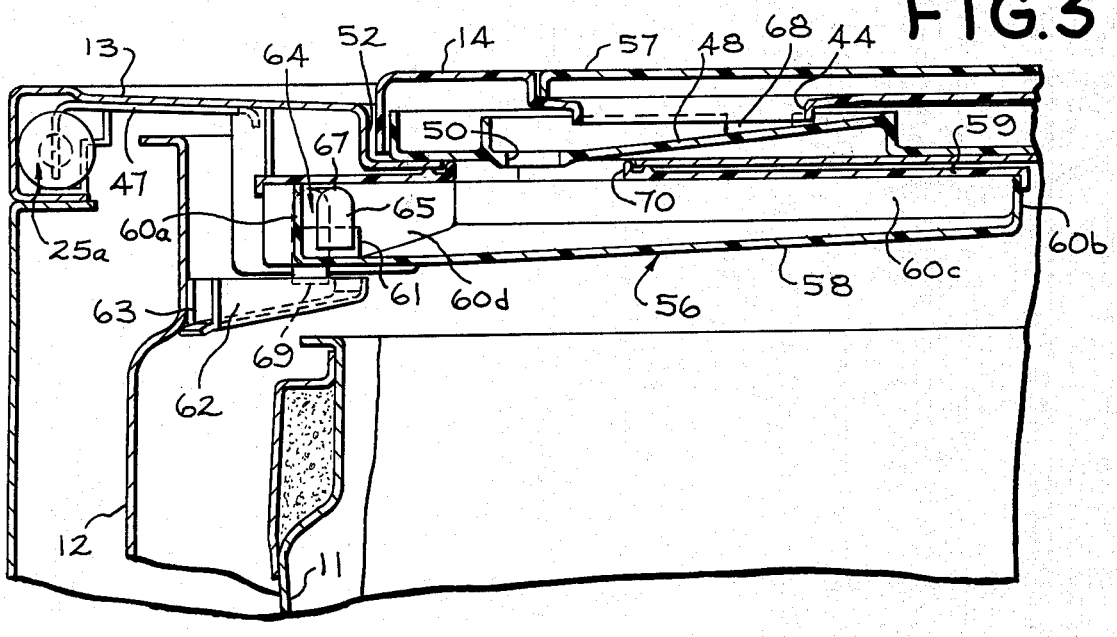

WASHING MACHINE WITH IMPROVED ADDITIVE DISPENSING MEANS

BACKGROUND OF THE INVENTION

1. Field of the Invention

This invention relates to laundry machines, and more particularly to a mechanism in the laundry machine to improve the dispensing of laundry agents.

2. Description of the Prior Art

Recent automatic clothes washing machines customarily proceed through a sequence of operations or cycles in order to wash, rinse and spin dry clothes. The sequence ordinarily includes a presoak, a first liquid extraction operation, a wash operation, a second liquid extraction operation, a rinse operation, and a final extraction operation.

In order to obtain the most desirable results from these machines, it has been found advantageous to introduce certain additives or agents into the water or liquid used for a particular operation. A prewash agent is normally used in the soak operation, a soap or detergent is normally used in the washing operation and a bleach is often also used in this operation, while rinse agents are added to the rinse water.

In an automatic washing machine, it is desirable that these agents be dispensed automatically. When the dispensing of agents is automatic, the user may load the farics to be washed into the wash basket and place the agents into their proper compartments or containers, and the machine automatically completes the cycle of operation. Also, the best results are obtained if these various agents are dispensed with liquid so that the additives are metered into the wash basket and evenly distributed rather than being concentrated into a few of the articles.

One such dispensing system for an automatic washing machine is disclosed in U.S. Pat. No. 3,727,434 assigned to the same assignee as the present invention. As disclosed in that patent, the dispenser is normally latched to the access cover of the laundry machine for movement with the cover in an open position for access to the wash basket for loading fabrics.

The dispenser includes a plurality of compartments for storing treating agents to be dispensed selectively during the prewash, wash and rinse operation and a plurality of liquid inlets arranged to communicate with the compartments. In its operative effective position over the basket the liquid inlets are in a position to cooperate with the outlets of a liquid supply device. A liquid supply device is sequentially controlled to selectively direct liquid into preselected ones of the liquid inlet for mixing liquid with the treating agents being held in the compartments to flush the agents into the wash basket at predetermined times in a cycle of the automatic washing machine.

In such a dispenser as described above, the dilution and flushing of bleach is particularly troublesome because of its propensity to discolor clothes if the bleach has not been properly diluted sufficiently prior to introduction into the basket containing the clothes. It is also desirable to have the diluted bleach dispensed not onto the clothes but rather into the liquid being used for the wash operation. In the dispensing of bleach by the dispensing system disclosed in the above-mentioned patent bleach is diluted by recirculating water, that is, water that is pumped from the wash tub and then reintroduced back into the tub. The bleach diluting tank is evacuated by a siphon tube, however, one of the difficulties with this arrangement is that recirculation water contains lint or other relatively large contaminants which when introduced into the bleach compartment can clog the siphon and render its operation unusable.

By my invention I have improved the additive dispensing system in that I have provided a means for diluting the bleach and flushing it from its compartment with fresh liquid and dispensing it into the wash water and not onto the fabrics being washed.

SUMMARY OF THE INVENTION

There is provided a treating agent dispenser system for an automatic washing machine of the top loading type having a cabinet, an outer tub, and a basket spaced inwardly therefrom that contains the fabric to be washed. The dispenser system includes a dispenser adapted to be mounted above the machine's wash tub and which has a plurality of compartments for receiving treating agents to be dispensed into the wash tub with a plurality of liquid inlet means arranged in liquid flow communication between each compartment and a liquid supply means arranged for directing liquid into the respective liquid inlet means to flush said agents into the wash tub at predetermined times in a cycle of the automatic washing machine.

This invention relates to an improvement in such a dispensing system and consists of providing one of the compartments with a channel and a drain opening therein. A stationary holding tank underlies the one compartment and has an outlet barrier for holding and diluting a treating agent with the liquid entering the tank before allowing the diluted mixture to flow over the barrier. There is also provided liquid flow communicating means between the said one compartment drain opening and the holding tank. Means are provided for evacuating the mixture held in the holding tank by said barrier after the liquid flow into the tank terminates and also means for directing the diluted mixture from the holding tank to the space between the tub and basket. Preferably, the predetermined time for directing liquid into the liquid inlet means of the one compartment is when the machine is being filled with fresh liquid for the wash operation.

BRIEF DESCRIPTION OF THE DRAWINGS

FIG. 1 is a schematic front elevational view of a clothes washing machine incorporating my invention, the view being partly broken away and partly in section.

FIG. 3 is a fragmentary sectional view taken along lines 3—3 of FIG. 2.

DESCRIPTION OF THE PREFERRED EMBODIMENT

Figure 2:
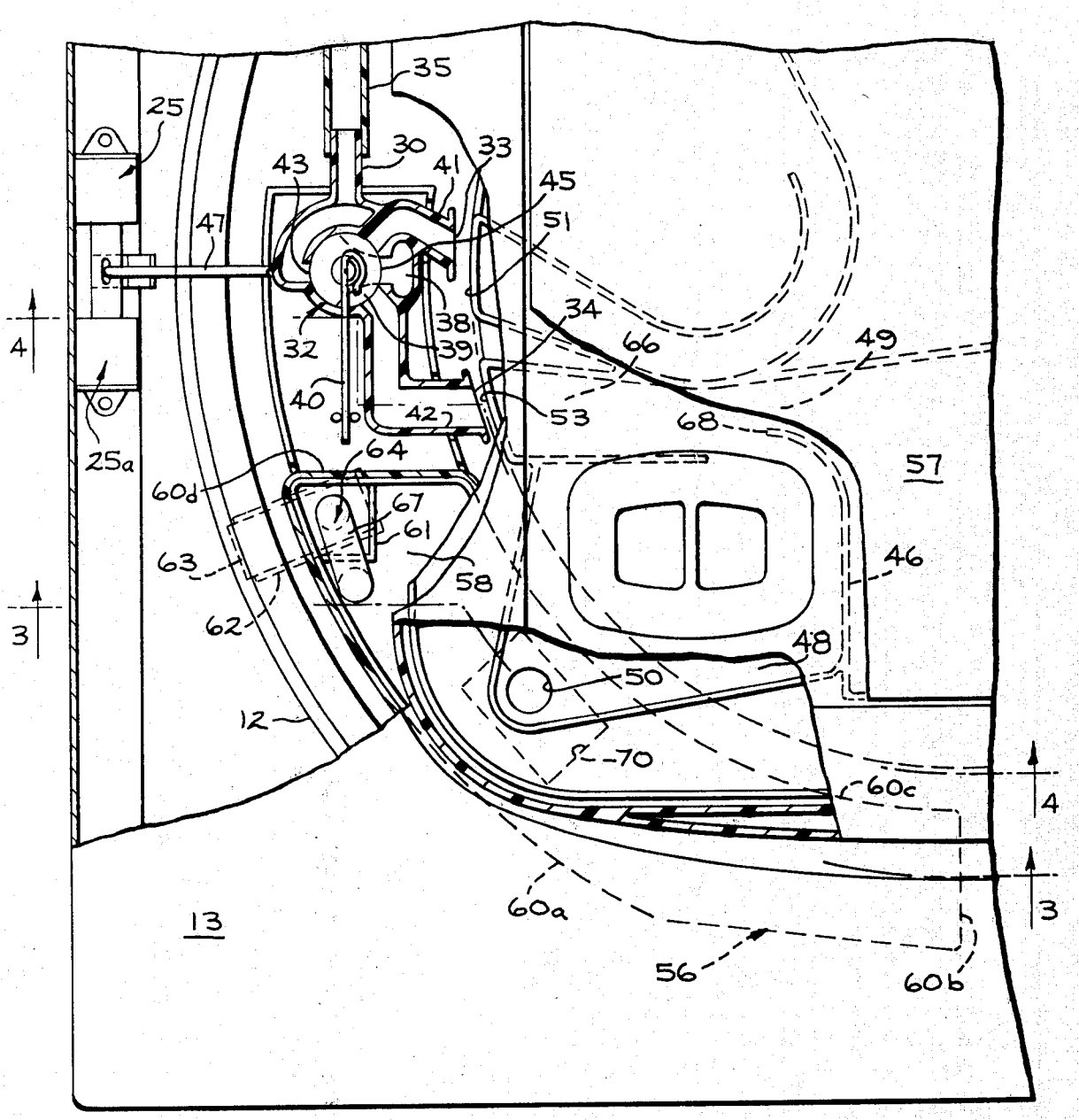
FIG. 2 is a plan view of the dispensing system of the present invention, the view being partly broken away and partly in section.
Figure 4:
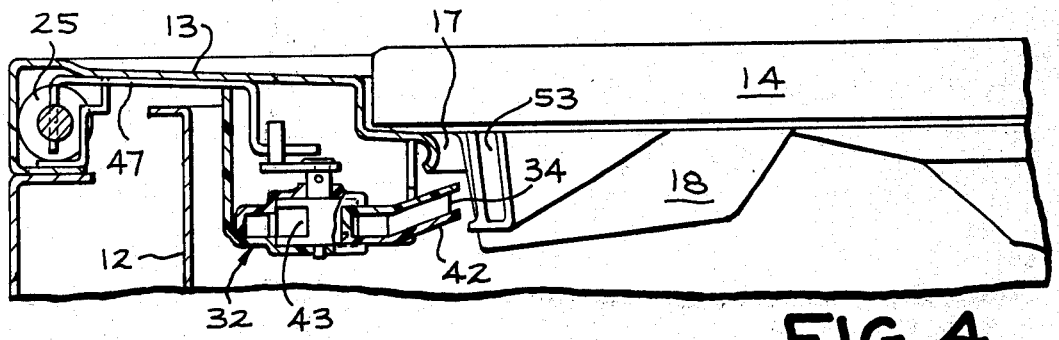
FIG. 4 is a fragmentary sectional view taken along lines 4—4 of FIG. 2.
Figure 5:
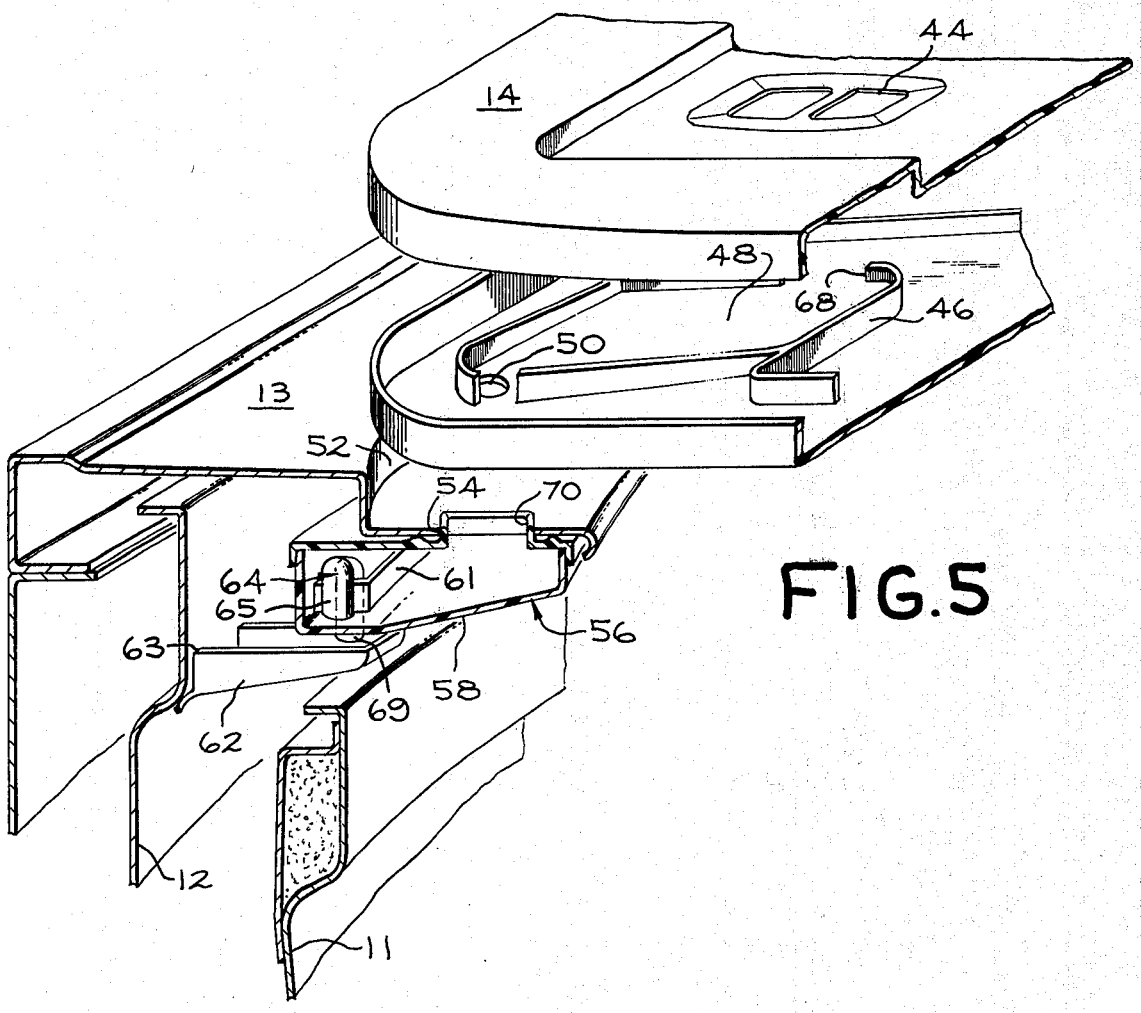
FIG. 5 is a perspective view of the dispensing system of the present invention with parts broken away.

Referring now to FIG. 1, there is shown a washing machine 10 having a conventional perforated wash basket 11 disposed within an outer imperforate liquid retaining tub 12. With this combination, the basket 11 and tub 12 form suitable means for containing liquid and the fabrics to be washed in said liquid. The outer tub 12 is rigidly mounted within an appearance cabinet 13 which includes an access lid or cover 14 hingedly mounted on the top portion of the cabinet for providing access through an opening 17 to the basket 11.

Shown positioned over the basket 11 and projecting into the opening 17 is a wash water treating agent dispenser 18 which includes part of the dispensing system of the present invention. Preferably this is effected by removably mounting the dispenser 18 to the underside of the access lid by suitable means. At the center of the wash basket 11 there is positioned an agitator 19 for flexing clothes during the washing operation. Conventionally, the basket 11 is mounted for rotation and the agitator 19 is mounted for some type of oscillatory motion which will effect washing action on the clothes in the basket 11.

Basket 11 and agitator 19 are driven from a reversible motor 21 through a drive including a clutch 22 which through a suitable belt 23 transmits power to a transmission 24. When the motor 21 is rotated in one direction the transmission causes a slow speed oscillation of the agitator 19. Conversely, when the motor is driven in the opposite direction the transmission drives both the basket 11 and agitator 19 at a high speed for centrifugal extraction of the liquid from the fabrics within the basket.

In addition to operating the transmission 24 as described, motor 21 also provides a direct drive to a pump structure that includes separate pumping units 26 and 27. During the high speed operation pump 27 draws liquid from the outer tub 12 and discharges it through conduit 28. During wash or slow speed the pump 26 draws liquid in through conduit 29 and discharges through conduit 31. Conduit 31 extends up and terminates in the tub wall and directs liquid flow into the basket 11, usually into a filter device, not shown, on top of the agitator.

Mounted on the cabinet 13 is a control compartment 36 in which are located control devices, including a cycle controller 37 which conducts the washing machine through cycles of operation.

There is also provided a dispensing system for an automatic fabric washing machine in which the user of the machine can select to store one or a combination of laundry additives or agents to be dispensed at preselected intervals in the cycle of an automatic washing machine. Such a dispensing system is described in U.S. Pat. No. 3,727,434 to John Bochan, assigned to General Electric Company, assignee of the present invention. That dispensing system used recirculation liquid whereas in the present invention fresh water being introduced into the machine is utilized to flush the respective laundry agents.

A mechanical diverter 32 is fixedly mounted within the cabinet, usually to the underside of the cabinet top, and has two of its outlets 33 and 34 arranged to cooperate with suitable inlets 51 and 53, respectively, in the dispenser 18 that will be discussed later in the description of the operation of the present invention. The diverter is controlled by solenoids 25 and 25*a* actuated in response to signals from the cycle controller 37. Liquid is introduced into the diverter through inlet 30 from a household plumbing fixture through conduit 35. The diverter is in effect a control valve that allows the incoming liquid to pass from inlet 30 to either outlet 33 or 34 for the dispensing system. Alternatively, the liquid may also be introduced directly into the wash tub

12 through outlet 38 and bypass the dispenser 18. The diverter has a rotatable flow directing central block 39 which is returned to the position shown in FIG. 2 by spring 40 when the solenoids 25 and 25a are not actuated to divert the liquid into channels 41 or 42 leading to outlets 33 or 34 respectively. The flow directing control block 39 is circular having a wide angle opening 43 at one position and a smaller angle outlet opening 45 opposite thereto that directs liquid to outlets 33, 34 or 38.

While the dispensing system utilizes a plurality of laundry agents, this invention relates to a structure utilized for introducing one additive or agent from the dispensing system into the tub. This dispensing system is primarily concerned with introducing bleach and provides for an assurance that the bleach is diluted prior to introduction into the wash tub 12 and that the diluted mixture is dispensed into the wash liquid and not onto the fabrics to be washed which are retained within the basket 11. For this reason, only one such laundry agent dispensing means is shown in FIGS. 2–5. The dispensing system includes a top panel opening 44 into which the laundry agent, such as bleach, is poured. The top panel openings including opening 44 have a cover 57 that is hinged to the larger access lid 14. The bleach poured into opening 44 flows into the underlying compartment 46 that has a bottom wall or channel 48 that is sloped toward a drain opening 50 at one end of the channel. Underlying the drain opening 50 is a cabinet portion 52 into which is recessed the access lid or cover 14 of the washing machine 10. This cabinet portion 52 has an opening 54 vertically disposed underneath the drain opening 50 so that the bleach passing through drain opening 50 will also pass down through opening 54 in the cabinet top wall. This opening 54 forms one means of liquid flow communication between the drain opening 50 and a holding tank 56, a portion of which tank is also vertically disposed underneath the drain opening 50. Drain opening 50, cabinet opening 54 and holding tank 56 are in vertical axial alignment with each other. The holding tank 56 is a curved structure and is stationarily affixed to the washing machine 10. The holding tank 56 includes a bottom wall 58, top wall 59 and side walls 60*a*, 60*b*, 60*c* and 60*d* which together form a liquid reservoir. The top wall 59 has an opening 70 to allow the bleach to enter the holding tank. The holding tank 56 has an overflow barrier 61 and its height is slightly below that of the side walls 60*a*, 60*b*, 60*c* and 60*d* such that the holding tank will retain liquid until the level in the holding tank reaches the top of the barrier 61 then flows over the barrier. Downstream of the barrier and in liquid flow communication therewith is a chute 62 that has the end 63 opposite from the barrier 61 located between the tub 12 and basket 11 such that liquid flowing into the chute is directed to the space between said tub and basket.

Provision is made to drain the holding tank 56 when the liquid flow into the holding tank terminates. One embodiment shown in connection with the present invention is a siphon tube 64. The siphon 64 has its short leg 65 positioned within the holding tank and a U-shaped portion 67 over the barrier 61 and the long leg 69 extends down outside the barrier 61 and is in liquid flow communication with the chute 62. The operation of this siphon is well known and functions to evacuate the holding tank once liquid being introduced into the holding tank rises to a level above the barrier 61 and siphon tube U-shaped portion 67 and the liquid being introduced into the holding tank is stopped.

The operation of the treating agent dispenser system is as follows. The washing machine operator pours the desired laundry agent, for instance bleach, through top panel opening 44 where it passes into bleach compartment 46 and flows down channel 48 to drain opening 50. By gravity the bleach passes through drain opening 50 and correspondingly through opening 54 in the cabinet top wall and opening 70 in the top wall of the holding tank where it then enters the holding tank 56 and is retained therein by the surrounding side walls and the barrier 61.

The washing machine is then started by the user by actuating the necessary controls including the cycle controller 37. Initially fresh water from the household fixture supply enters the machine through conduit 35 and in turn to the inlet 30 of the diverter 32. At this time the cycle controller 37 does not actuate solenoid 25 or solenoid 25*a* to rotate the valve block 39 so the liquid goes directly into the machine through outlet 38. The machine fills until the liquid inlet valve is automatically turned off, at which time the cycle controller also is actuated and begins to run. This is the soak operation after which the liquid is pumped out of the machine. In the next operation fresh liquid again enters the machine as before but the cycle controller 37 actuates solenoid 25 which through linkage 47 rotates the center block 39 to align outlet opening 45 with channel 42 thus allowing incoming liquid to pass from inlet 30 through center block opening 43 to outlet opening 45, through channel 42 and out diverter outlet 34. The liquid then enters the dispenser 18 through inlet opening 53.

The fresh water passing through diverter outlet 34 flows into a portion 66 of the dispenser 18 where it splits into two flow paths, one being the inlet 49 leading to the detergent compartment, not shown, and the other being an opening 68 in the bleach compartment 46 to allow the liquid diverted into the bleach compartment to flow therein and from there on follow the same path that the bleach agent had followed. Namely, the fresh liquid flows down the channel 48 and through drain opening 50 and then by gravity through opening 54 in the cabinet top wall and into the holding tank 56. In this manner, the fresh water will in effect flush or rinse any of the residue bleach left in the bleach compartment and the flow path to the holding tank 56. Once the fresh liquid enters the holding tank the liquid level continues to rise and simultaneously dilutes the bleach that has been retained therein. When the dilute mixture liquid level reaches the top of the barrier 61 it flows thereover and down into the chute 62 whereupon it is directed by the chute over to the tub wall 12 and where it falls into the space between the tub 12 and inner basket 11. In this manner it will be appreciated that the diluted bleach mixture is not dispensed onto the clothes within the basket 11 but rather is directed down into the underlying wash liquid which is being introduced into the washing machine both through detergent compartment and bleach compartment.

When the machine has been filled to its appropriate water level the fresh water or liquid being introduced into the machine is again automatically terminated and the solenoid 25 deactuated thus allowing spring return of the center block 39 to the position shown in FIG. 2. When that happens the holding tank 56 is still full of the liquid, however, the siphon tube 64 proceeds to operate as discussed above thus draining or evacuating the holding tank to allow reintroduction of the bleach when the machine is next used to wash a load of clothes.

The cycle controller 37 may proceed with the automatic dispensing of a rinse laundry agent from the other compartment of the dispenser system as appropriate in the washing cycle by actuation solenoid 25a causing the center block 39 to rotate and align outlet 45 with channel 41 so that incoming rinse liquid will pass into the dispenser 18 via inlet 51 and then to the rinse agent compartment thereby flushing it into the underlying tub. After the rinse operation the wash tub is drained preparatory for the next wash load.

The foregoing is a description of the preferred embodiment of the invention and variations may be made thereto without departing from the true spirit of the invention, as defined in the appended claims.

What is claimed is:

1. In a treating agent dispenser system for an automatic washing machine of the top loading type having a cabinet, an outer tub, and a basket spaced inwardly therefrom, including a dispenser adapted to be mounted above the machine's tub, said dispenser having a plurality of compartments for receiving treating agents to be dispensed into the wash tub and a plurality of liquid inlet means arranged in liquid flow communication between each compartment and a liquid supply means arranged for directing liquid into the respective liquid inlet means to flush said agents into the wash tub at predetermined times in a cycle of said automatic washing machine, the improvement comprising:

a. one of the compartments being for receiving a bleach agent and having a channel and a drain opening therein, b. the liquid supply means includes a controlled mechanical liquid diverter that directs fresh liquid into said one compartment when the machine is being filled with liquid for the wash operation, c. a stationary holding tank having an outlet barrier for holding and diluting a treating agent with the liquid entering the tank before allowing the diluted mixture to flow over the barrier, d. liquid flow communicating means between the said one compartment drain opening and the holding tank, e. means for evacuating the mixture held in the holding tank by said barrier after the liquid flow into the tank terminates, and f. means for directing the diluted mixture from the holding tank to the tub wall.

2. In the treating agent dispenser system of claim 1 wherein a portion of the holding tank underlies the said one compartment drain opening and is in vertical alignment therewith.

3. In the treating agent dispenser system of claim 2 wherein the liquid flow communicating means between the said one compartment drain opening and the holding tank is an opening through the machine cabinet.

4. In the treating agent dispenser system of claim 1 wherein the means for evacuating the mixture held in the holding tank is a siphon.

5. In the treating agent dispenser system of claim 1 wherein the means for directing the diluted mixture from the holding tank to the tub wall is a chute that extends from the holding tank to the tub.

* * * * *